US005115144A

United States Patent [19]

Konishi et al.

[11] Patent Number: 5,115,144

[45] Date of Patent: May 19, 1992

[54] AUTOMATIC SELECTION APPARATUS OF SHEET MATERIAL

[75] Inventors: Kouji Konishi; Tadayoshi Ohshima; Masakazu Fujii, all of Hiroshima; Motoyuki Hagino, Tokyo; Satoshi Hosono, Tokyo; Masayoshi Miyake, Tokyo, all of Japan

[73] Assignees: Mitsubishi Jukogyo Kabushiki Kaisha; Oji Paper Company Ltd.; Toei Electronics Co., Ltd., all of Tokyo, Japan

[21] Appl. No.: 742,286

[22] Filed: Aug. 8, 1991

Related U.S. Application Data

[63] Continuation of Ser. No. 625,706, Dec. 11, 1990, abandoned, which is a continuation of Ser. No. 501,354, Mar. 28, 1990, abandoned, which is a continuation of Ser. No. 316,522, Feb. 27, 1989, abandoned, which is a continuation of Ser. No. 41,284, Apr. 22, 1987, abandoned.

[30] Foreign Application Priority Data

Apr. 23, 1986 [JP] Japan ..... 61-93680

[51] Int. Cl.[5] ..... G01N 9/04; G01N 21/88

[52] U.S. Cl. ..... 250/572; 250/223 R; 271/204; 209/587; 209/903; 209/588

[58] Field of Search ..... 250/223 R, 562, 563, 250/572, 223 B; 271/277, 204, 205, 206; 209/587, 903, 588, 577; 356/430, 431

[56] References Cited

U.S. PATENT DOCUMENTS

| | | | |
|---|---|---|---|
| 3,118,665 | 1/1964 | Thompson et al. | 209/903 |
| 3,941,370 | 3/1976 | Martin et al. | 271/64 |
| 4,226,538 | 10/1980 | Van Beeck | 356/430 |
| 4,404,905 | 9/1983 | Simeth et al. | 271/277 |
| 4,448,408 | 5/1984 | Faltin | 271/277 |
| 4,462,588 | 7/1984 | Kogane | 271/277 |
| 4,737,649 | 4/1988 | Naruse | 250/562 |

FOREIGN PATENT DOCUMENTS

| | | | |
|---|---|---|---|
| 0062785 | 3/1982 | European Pat. Off. . | |
| 976205 | 4/1963 | Fed. Rep. of Germany . | |
| 2519610 | 11/1976 | Fed. Rep. of Germany . | |
| 2901940 | 7/1979 | Fed. Rep. of Germany . | |
| 2850351 | 5/1980 | Fed. Rep. of Germany . | |
| 3015169 | 1/1981 | Fed. Rep. of Germany . | |
| 0033467 | 3/1979 | Japan | 271/277 |
| 82/00995 | 4/1982 | PCT Int'l Appl. . | |
| 1429214 | 3/1976 | United Kingdom . | |

*Primary Examiner*—David C. Nelms
*Assistant Examiner*—Michael Messinger

[57] ABSTRACT

An automatic selection apparatus for sheet material can automatically distinguish whether sheet materials such as sheets of paper are good or bad. While the sheet materials are carried one by one in the direction perpendicular to the flow direction in the manufacturing process or working process of the sheet materials with a leading edge thereof being held by a gripper, an optical type defect detection device detects a defect in the sheet material. Accordingly, vibration of the sheet material is avoided and the defect can be accurately detected. A controller receives a signal from the defect detection device and drives a switching device which opens and closes the gripper at a defective sheet discharged portion or a good sheet stacked portion.

12 Claims, 3 Drawing Sheets

AUTOMATIC SELECTION APPARATUS OF SHEET MATERIAL

This application is a continuation of application Ser. No. 07/625,706 filed on Dec. 11, 1990, now abandoned, which is a continuation of application Ser. No. 07/501,354 filed on Mar. 28, 1990, now abandoned, which is a continuation of application Ser. No. 07/316,522 filed on Feb. 27, 1989, now abandoned, which is a continuation of application Ser. No. 041,284 filed on Apr. 22, 1987, now abandoned.

BACKGROUND OF THE INVENTION

1. Field of the Invention

The present invention relates to an automatic selection apparatus of sheet material which detects defects of sheet material such as, for example, paper and selects good sheet material automatically and continuously.

2. Description of the Prior Art

Heretofore, selection of paper is generally made by human eyes. On the other hand, an automatic selection apparatus has been proposed as described above in which stacked sheets of paper are put on a belt one by one and carried so that a defect detection device disposed above the belt detects defects of the sheets of paper to distinguish whether the sheets of paper are good or bad. Furthermore, there has been proposed another apparatus in which the sheets of paper are carried while being held between upper and lower belts.

The conventional automatic selection apparatus carries the sheets of paper put on the belt or held between the upper and lower belts. Accordingly the carried sheets experience small vibrations in the carrying direction and in the transverse direction due to sliding generated between the belt and the sheets and between the belt and a driving portion of the belt. Consequently, it can not be distinguished whether a detected signal of the defect detection device is a signal due to small defect of the sheet of paper or a signal due to the vibration. Further, when a gap is provided in the carrying line of the sheets of paper in which the belt on which the sheets of paper are put or the belts between which the sheets of paper are held are disconnected, the carrying velocity of the sheet of paper is greatly reduced for a very short time when the leading edge of the sheet is transferred to a next belt after the leading edge has passed the gap and consequently the sheet of paper fluctuates. Accordingly, it is difficult for the detection device to detect a small defect of the sheet of paper. In this manner, the conventional automatic selection apparatus can not detect small defects accurately and has a defect detection capability greatly inferior to a defect by human eyes. Thus, the sheets of paper that are distinguished as good products by the apparatus are not used when they should be.

SUMMARY OF THE INVENTION

The present invention has been proposed in view of the above problems in the prior art and comprises, as a means for solving the problems, a feeding device for feeding sheet materials in a stack one by one in a direction perpendicular to a flow direction in a manufacturing process or working process of the sheet materials, a carrying device including a plurality of grippers for selectively holding a leading edge of the sheet materials fed from the feeding device which moves the grippers along a predetermined passage to carry the sheet materials, an optical defect detection device disposed in a traveling passage of the sheet materials by the carrying device, a plurality of switching devices disposed along the traveling passage of the sheet materials by the carrying device which selectively actuates the gripper to stop the sheet materials from being held, a control device responsive to a signal of the defect detection device to selectively actuate the plurality of switching devices so that the sheet materials are selectively discharged.

The sheet materials fed from the feeding device are always held by the grippers and carried in a stable state. The defect detection device detects defects of the sheet materials during the carrying operation. The control device receives a signal from the defect detection device and distinguishes whether the sheet materials are good or bad to selectively actuate each of the switching devices so that the sheet materials are selectively discharged.

As described above, according to the present invention, the leading edge of the sheet material is held by the gripper so that the sheet material is carried in a stable state and a defect of the sheet material is detected during the carrying operation. Accordingly, small defects can be detected and a high degree of exact selection of the sheet materials can be attained. Since automatic selection can be attained by inputting the signal of the detection device to the control device while carrying the sheet materials, a high speed and high accuracy selection operation can be attained by anyone.

Other objects and advantages of the present invention will become apparent from the following description. However, it should be understood that the detailed description and specific examples, while indicating preferred embodiments of the invention are given by way. Further scope of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a side view schematically illustrating the whole apparatus of the present invention for automatically selecting sheet materials;

FIG. 2 is a plan view of the apparatus of FIG. 1;

FIG. 3 is a side view of a of the present invention;

FIG. 4 is a plan view of FIG. 3;

FIG. 5 is a perspective view schematically illustrating a streak detector of the present invention; and FIG. 6 is a longitudinal sectional view of an illuminator used in the detector of FIG. 5.

DETAILED DESCRIPTION OF THE INVENTION

Figure 1:
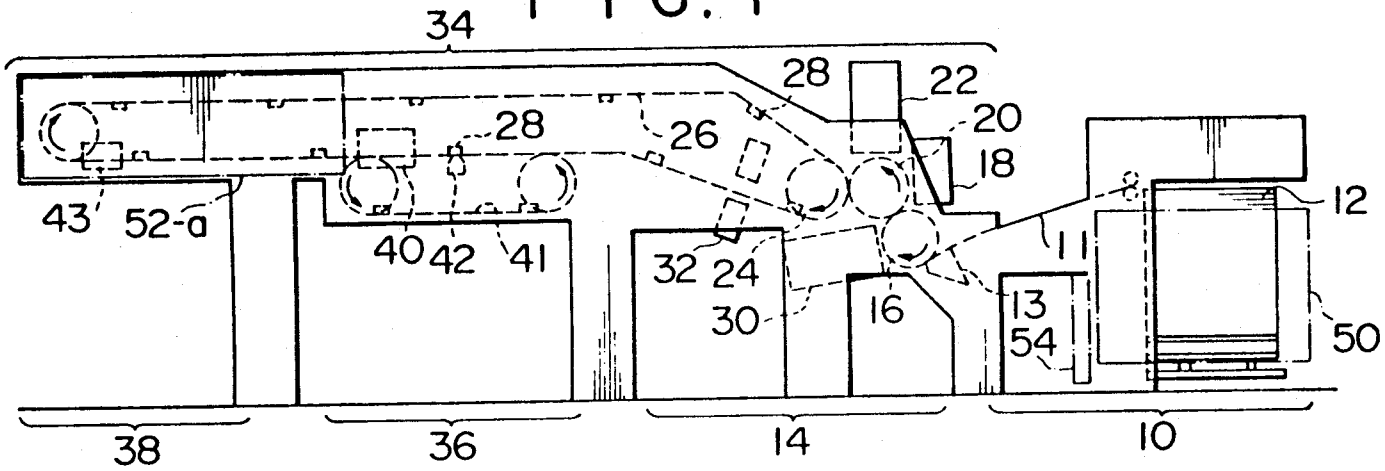
FIGS. 1 to 6 show an embodiment of the present.
Figure 2:
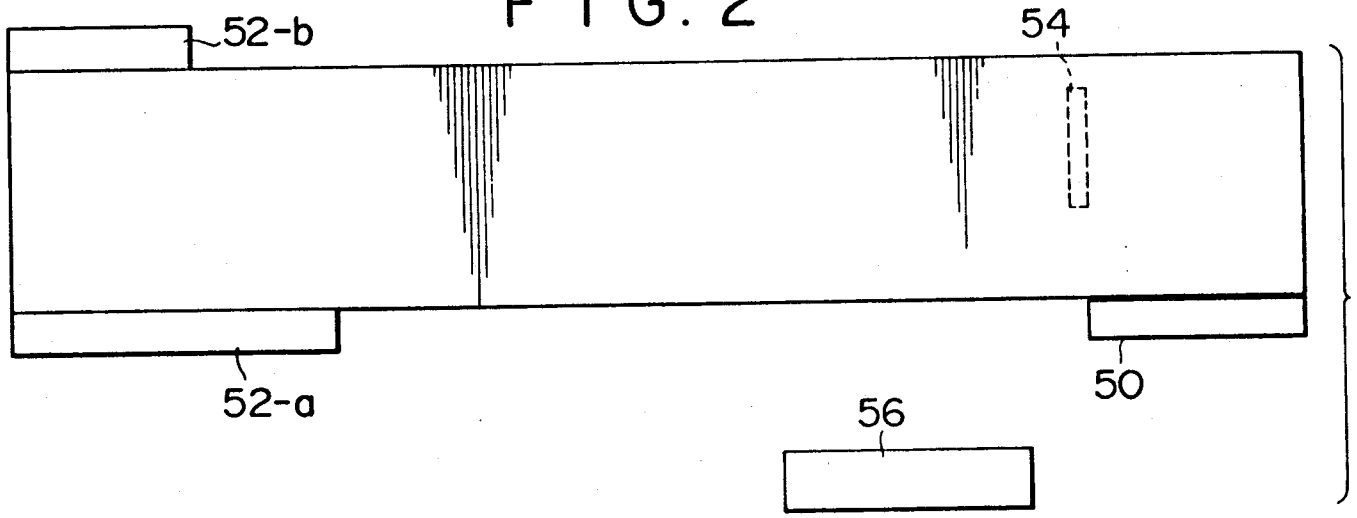

The present invention is now described with reference to an embodiment shown in FIGS. 1 to 6. The embodiment is directed to an automatic selection apparatus for sheets of paper (hereinafter referred to as plane sheets) cut into a sheet by a cutter after manufacturing of the paper. A paper feeding device 10 shown in FIG. 1 includes the plane sheets 12 stacked on a pallet which moves up and down and continuously feeds the plane sheets one by one from the top of the stack onto a board 11 to deliver the sheets through a swing gripper 13 to a next stage after the sheets have been positioned on the board 11. At this time, the feeding direction of the plane sheets 12 is in the direction perpendicular to the flow direction in the manufacturing process of paper. A carrying device 34 comprises a first inspection drum 16, a second inspection drum 20 and a carrying chain 26. The first and second inspection drums 16 and 20 are provided at peripheries thereof with grippers 28 which can hold the plane sheets 12 and deliver them to a next stage. The carrying chain 26 is also provided with a plurality of grippers 28 disposed at predetermined intervals.

Figure 3:
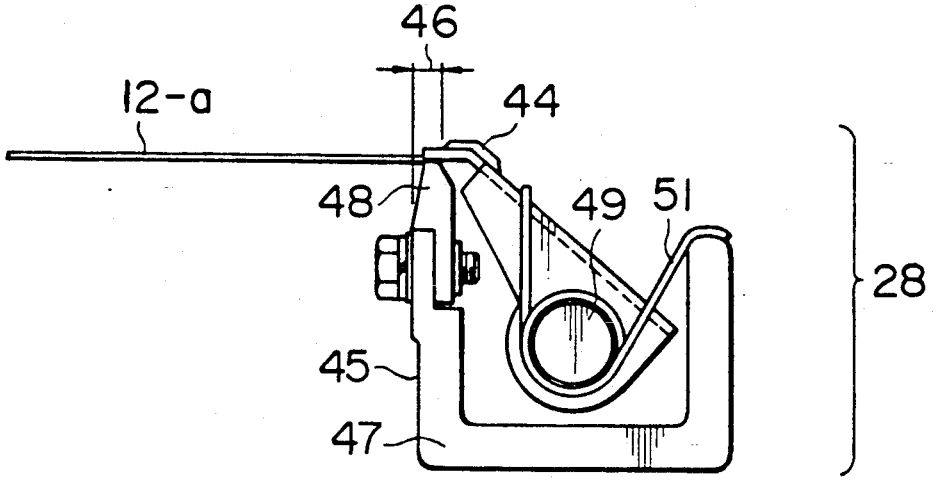
Figure 4:
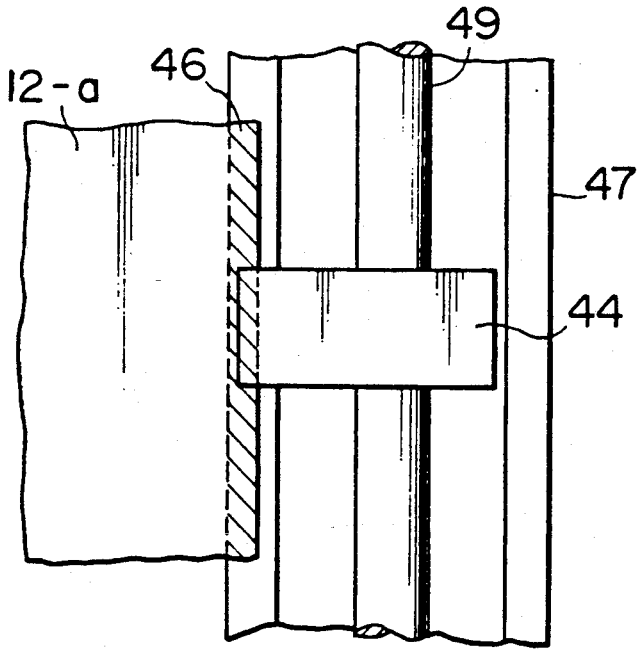
Figure 5:
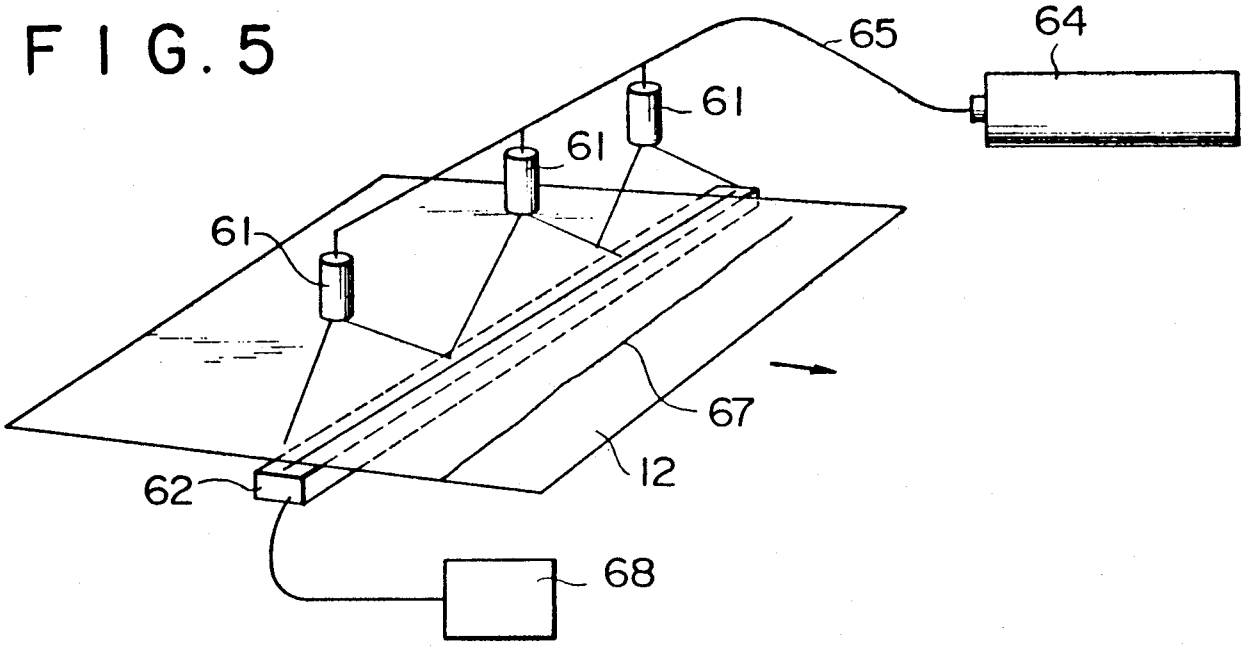

As shown in FIG. 3, the gripper 28 comprises a nail 44 and a nail prop 45. The nail prop 45 comprises in detail a nail seat shaft 47 formed of a frame having a section in the form of a channel and a plurality of nail seats 48 mounted at one end of the nail seat shaft 47 by a bolt. The plurality of nail seats 48 are disposed at predetermined intervals along a lengthwise direction of the nail seat shaft 47. A nail spindle 49 is disposed in a recess of the nail seat shaft 47 and is provided with the nails 44 disposed opposite to the nail seats 48 of which the number of nail seats identical with the number of nails 44. The nails 44 are pressed to the nail seats 48 by a spring 51. The nails 44 are separated from the nail seats 48 by rotating the nail shaft 49. The gripper 28 holds a leading edge of the plane sheet 12 between the nail 44 and the nail seat 45. Most of the gripper 28 is in a position where the gripper is not engaged with the plane sheet 12 and accordingly the area 46 where transmission light is interrupted, that is, the holding area of the plane sheet 12 is very small.

Numeral 14 in FIG. 1 denotes a detection unit and numeral 18 denotes a reflection type crease detector disposed opposite to the second inspection drum 20. In the detection method of the crease detector 18, light is irradiated on the plane sheet 12 at a certain angle and the reflected light from the plane sheet is received at a certain angle. It is necessary to properly select a form (a circle, an oval, a rectangle, a slit) of illuminating and receiving light for the field of detection. The crease detector 18 is provided with illuminators of several types having different conditions described above.

Generally, creases are formed in the flow direction in the manufacturing process of paper. Accordingly, when the plane sheets are fed in the direction perpendicular to the flow direction as in the invention, the creases pass as lines in the transverse direction and the crease detector 18 configured above can accordingly detect various creases. The crease detector 18 includes a special small halogen lamp for producing illuminating light and a light receiving unit formed of a monolithic photoelectric element. A gas laser, a semiconductor laser, an incandescent electric lamp, a sodium lamp and the like can be used for the illuminating light.

Numerals 22 and 30 denote ordinary defect detection devices. The detection device 22 is disposed opposite to the second inspection drum 20. The detection device 30 is a reflection type and is disposed opposite to the first inspection drum 16. The detection devices 22 and 30 comprise a fluorescent lamp for producing illuminating light and a light receiving device formed of a CCD element, respectively. The detection devices 22 and 30 detect holes, dark points, dirt, dust and the like on two sides of the plane sheets 12. The detection devices 22 and 30 are capable of distinguishing the size of light dirt which is difficult to be detected heretofore.

Figure 6:
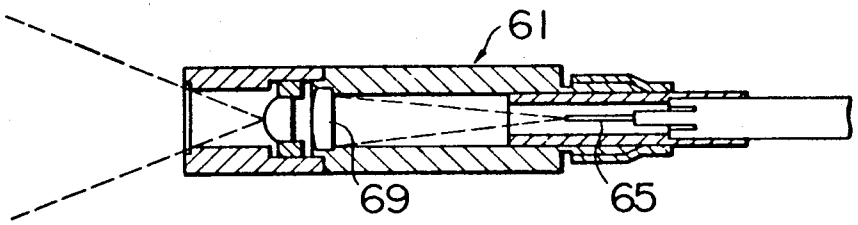

Numeral 32 denotes a light transmission type streak detector. The detector 32 is described with reference to FIGS. 5 and 6, in which numeral 61 denotes a plurality of laser illuminators disposed in the width direction. A laser receiver 62 is disposed opposite to the laser illuminators 61. As shown in FIG. 6, the laser illuminator 61 is provided with an optical lens system 69 disposed in the front of an optical fiber 65. The optical lens system 69 comprises a condensing lens and a semicylindrical lens. Laser light from the optical fiber 65 is converged by the condensing lens of the optical lens system 32 and is converted into a slit-shaped light spreading only in one direction by the cylindrical lens. Shapes of the slit of light produced from the laser illuminators 61 are different. The laser light is supplied to the laser illuminators 61 through the optical fiber 65 from a laser light generator 64 and is irradiated on the surface of the traveling plane sheet 12. The laser light then transmits the plane sheet 12 and is received by the laser receiver 62. A signal from the laser receiver 62 is supplied to a processing circuit 68.

A streak 67 is a narrow defect having a length in the flow direction in the manufacturing process of paper. Accordingly, in the present invention, when the plane sheet is fed in the direction perpendicular to the flow direction, the plane sheet 12 passes through the detector 32 while maintaining the lengthwise direction of the streak in the width direction of the sheet. The detector 32 is provided with the plurality of laser illuminators 61 having different slit-shaped laser light. Accordingly, the detector can detect a wide range of various streaks containing narrow streaks, wide streaks, sharp streaks, dim streaks and the like. The detector employs a slit-shaped laser beam as the illuminating light and the light receiving device 62 is formed of a monolithic photoelectric element. The detector 32 can detect streaks having a width of several tens of microns or more.

Numeral 40 in FIG. 1 denotes a switching cam device which selectively transfers the plane sheet 12 being carried while held by the gripper 28 that is attached to the chain 26 for a moving gripper 42 attached to another chain 41. The plane sheets 12 transferred to the gripper 42 are discharged to a defective paper discharged portion 36. Numeral 43 denotes another switching cam device which opens the nail 44 of the gripper 28 to discharge the plane sheets 12 to a good paper stacked portion 38 so that the plane sheets 12 are stacked thereto. Numeral 50 denotes a main controller, numeral 52 denotes a good paper stacked portion controller, numeral 54 denotes a driver controller and numeral 56 denotes a detector controller. These controllers perform signal processing of the defect controllers 18, 22, 30 and 32, setting of defect distinguishing level, processing of collected data, and distinguishing of good and bad plane sheets in accordance with a feeding speed of the plane sheets.

Operation of the apparatus will now be described. The type, weight ($g/m^2$) and dimension of the plane sheets 12 to be selected and a defect distinguishing level for the plane sheets 12 are inputted to the apparatus. Levels of signal processing circuits of the defect detection devices 18, 22, 30 and 32 are automatically set in response to the inputted information. In this state, the plane sheets 12 are fed from the paper feeding device 10 one by one. The sheets 12 pass the swing gripper 13, the first and second inspection drums, 16 and 20, successively and are held by the gripper 28 to be stably carried by the chain 26. At this time, the sheets 12 are fed in the direction perpendicular to the flow direction of the working process. Consequently, the detection of creases and streaks that are produced along a length in the flow direction of the working process are facilitated.

A measuring level of the quality of the sheets is automatically set by the passage of first several sheets and subsequently the defect detection is started. The carried sheets 12 are distinguished as to whether the sheets are good or bad on the basis of signals from the detectors 18, 22, 30 and 32. The sheets that are distinguished as bad sheets are transferred to the gripper 42 by the operation of the switching cam device 40 and are stacked in the defective paper discharged portion 36. On the other hand, the sheets that are distinguished as good sheets are stacked to the good paper stacked portion 38 by the operation of the switching cam device 43. The decision as to whether the sheets are good or defective is determined in accordance with the priority order of the detects after the sheets 12 have passed all of the detectors. Further, the number of good and defective sheets is counted and a tape is inserted between the stacked sheets every predetermined number of sheets. The counted number of sheets is processed by a computer so that the defect ratio and the number of sheets are printed for each skid and kind in the form of a daily and monthly report so that the data is utilized for quality and production control.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An automatic selection apparatus for detecting defects and sorting a stack of sheet materials comprising:

feeding means for individually feeding said sheet materials into the apparatus in a perpendicular direction to a flow direction of a manufacturing process for said sheet materials;

carrying means having a plurality of inspection drums and a downstream carrying chain with a plurality of grippers, the plurality of inspection drums receiving the individual sheet materials from the feeding means and transferring the individual sheet materials to the carrying chain, some of the plurality of grippers holding a front edge of each of said sheet material as the material is fed by the carrying chain;

first optical defect detection means having at least one reflection type detector facing one of the plurality of inspection drums for detecting defects while said sheet material is on said inspection drum, the sheet material being free of the carrying chain when the at least one reflection type detector is detecting defects;

second optical defect detection means having a laser light transmission type detector facing said carrying chain for detecting defects of said sheet material carried by the carrying chains by using a plurality of laser illuminators;

switching means disposed adjacent the carrying chain for selectively activating said carrying means which discontinues movement of said sheet materials by said carrying chain; and control means for discharging said sheet materials into a first bin and a second bin in response to said first and second optical defect detection means.

2. The automatic selection apparatus according to claim 1, wherein said feeding means comprises a pallet for vertically moving the stack of sheet materials, a swing gripper for delivering the sheet materials to one of the plurality of inspection drums for inspection by said first optical detection means, and a board for individually receiving the sheet materials from a top of the stack and for delivering the sheet material received from said board to said swing gripper in said perpendicular direction to said flow direction.

3. The automatic selection apparatus according to claim 1, wherein said carrying chain is an endless chain having said plurality of grippers attached thereto.

4. The automatic selection apparatus according to claim 3, wherein each of said plurality of grippers comprises a nail and a nail prop for holding the front edge of the sheet materials therebetween.

5. The automatic selection apparatus according to claim 1, wherein said first optical defect detection means comprises a crease detector, and a sheet defect detector means for determining whether said sheet material has at least one of holes, dark points, dirt and contaminants thereon.

6. The automatic selection apparatus according to claim 5, wherein said crease detector comprises a plurality of reflection type illuminators.

7. The automatic selection apparatus according to claim 5, wherein said sheet defect detector means comprises a reflection type detector.

8. The automatic selection apparatus according to claim 1, wherein said laser light transmission type detector comprises a slit-shaped laser beam and a monolithic photoelectric element.

9. The automatic selection apparatus according to claim 7, wherein said reflection type detector comprises a flourescent lamp and a CCD element.

10. The automatic selection apparatus according to claim 1, wherein the first bin is for acceptable sheet materials and the second bin is for defective sheet materials, the first bin being positioned upstream from the second bin such that the sheet materials would be conveyed first to the first bin, the control means discharging the sheet materials to the first bin if the first and second optical defect detection means find the sheet materials to be acceptable and the control means discharging the sheet materials to the second bin if the first and second optical defect detection means find the sheet materials defective.

11. The automatic selection apparatus according to claim 1, wherein each of said plurality of grippers comprise a nail and a nail prop for holding the front edge of the sheet materials therebetween.

12. The automatic selection apparatus according to claim 11, wherein the nail prop comprises a nail seat shaft having a generally u-shaped cross section and a plurality of nail seats mounted to one end of the nails seat shaft, each of the grippers further having a nail spindle disposed within the nail seat shaft and a spring for each of the nails, the nails being pivotally mounted on the nail seat shaft of the gripper and each of the springs urging one of the nails toward one of the nail seats, the sheet material being held by the gripper between the nail seat and the nail, the nails and nail seats of each gripper being disposed along the length of the nail seat shaft.

* * * * *